United States Patent [19]

Owen

[11] Patent Number: 4,562,384

[45] Date of Patent: Dec. 31, 1985

[54] VARIABLE REACTANCE INDUCTOR WITH ADJUSTABLE RANGES

[75] Inventor: Daniel V. Owen, Hendersonville, N.C.

[73] Assignee: General Electric Company, Gainesville, Fla.

[21] Appl. No.: 486,469

[22] Filed: Apr. 19, 1983

[51] Int. Cl.[4] ..... H05B 41/16; H05B 41/24

[52] U.S. Cl. ..... 315/276; 315/278; 315/284; 315/259; 336/160; 336/165

[58] Field of Search ..... 315/276, 278, 279, 282, 315/283, 284, 258, 259; 336/160, 165

[56] References Cited

U.S. PATENT DOCUMENTS

| | | | |
|---|---|---|---|
| 2,392,845 | 1/1946 | Foerste | 315/279 X |
| 2,553,591 | 5/1951 | Kronmiller | 336/165 X |
| 2,664,541 | 12/1953 | Henderson | 315/279 X |
| 3,521,152 | 7/1970 | Emerson | 336/165 X |
| 3,873,910 | 3/1975 | Willis, Jr. | 315/278 |
| 4,162,428 | 7/1979 | Elms | 315/284 |

*Primary Examiner*—Saxfield Chatmon

*Attorney, Agent, or Firm*—Henry J. Policinski

[57] ABSTRACT

A discharge lamp ballast for stabilizing wattage input into a discharge lamp at different levels in two or more ranges comprises a magnetic core forming a closed magnetic circuit. A main winding on the core may be used alone or with an extended winding switched in series, and be connected in series with the lamp across an alternating current source in a lamp operating circuit. A control winding on the core has a triac connected across it to vary the current and thereby the wattage supplied to the lamp in the operating circuit. A pair of gapped shunts, one located between the control winding and the extended winding, and the other between the extended winding and the main winding, assure a proportionally greater control effect on the series reactance in the lamp operating circuit when the extended winding is switched in than when it is not.

6 Claims, 1 Drawing Figure

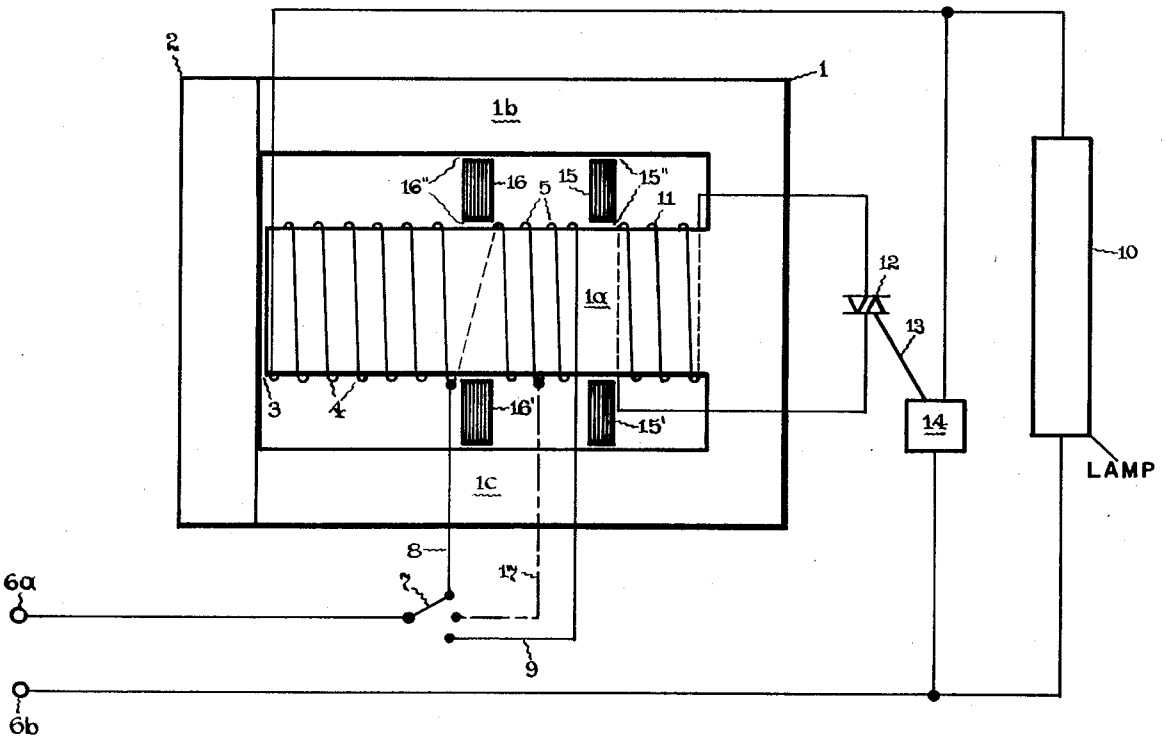
LAMP
10
14
13
12
1
1a
1b
1c
2
3
4
5
6a
6b
7
8
9
11
15
15'
15"
16
16'
16"
17

VARIABLE REACTANCE INDUCTOR WITH ADJUSTABLE RANGES

The invention relates to variable reactance inductors particularly useful as ballasts for controlling the power supplied to a high intensity discharge (HID) lamp load.

BACKGROUND OF THE INVENTION

Ballasts which use electronic switches such as triacs in phase control circuits for achieving close regulation together with controlled variation of discharge lamp current are known. Willis U.S. Pat. No. 3,873,910, Ballast Control Device, discloses such a ballast comprising an inductor having two windings separated by a shunt providing magnetic leakage. One winding, conveniently termed the main or running winding, is connected in series with the lamp across the A.C. line. The other winding is a control winding and has an electronic switch such as a triac connected across it. The inductance of the main winding when the switch in the control winding is open is determined by the turns in the main winding and the total magnetic path of the core structure. When the switch is closed, the current induced in the control winding produces a flux opposing the main winding flux. As a result, the main flux is forced through the shunt and its included air gap which make a magnetic path of higher total reluctance. This lowers the effective inductance of the main winding and permits the current to increase, thus increasing lamp wattage. By appropriately varying the firing phase angle, that is the moment in the A.C. cycle at which the triac is fired, the wattage input into the lamp may be regulated to achieve constant light output notwithstanding line voltage variations.

The firing phase angle of the triac may also be varied to control light output, that is to dim or brighten the lamp. However, when the control winding is shorted by a phase controlled triac the current goes to a higher level as the inductance is lowered. If the difference in lamp current between open control winding and shorted control winding is too great, the lamp voltage rises as a result of current starvation at the beginning of each half cycle. Thus this method of control causes line current distortion in the form of high third harmonic and high instantaneous lamp voltage which can cause premature lamp dropout. These problems limit the practical range of wattage control, although the control range is entirely sufficient for maintaining lamp wattage constant as against line voltage variations.

In order to economize energy, more and more industrial and commercial lighting installations now include means for varying the light level depending upon time of day and the activity going on. In one such arrangement known as remote energy management, the light levels at various places are controlled by signals from a central location. Typically, it is desired to control the input wattage into a high pressure sodium vapor lamp in 50-watt steps starting at 150 watts and going up to 450 watts. In order to use the Willis circuit, the initial approach was to have two running windings together with one control winding. One running winding, known as the main winding, was used for the high wattage range (300–450 watts) which requires low reactance. Both running windings, the main and an extended winding, were connected in series for the low wattage range (150–250 watts) which requires higher reactance.

Switching from the high range to the low range was done by a relay.

In the foregoing arrangement the limits of each control range must be adequate to accommodate the upper wattage setting at low line voltage and the lower wattage setting at high line voltage. The lower wattage limits are determined by the number of turns on the two running windings taken together and the main magnetic path reluctance with the control winding open. The main magnetic path generally includes an air gap which contributes the largest part of the reluctance. The upper wattage limits are determined by the magnetic shunt path with the control winding shorted. When the limits are set as tight as possible for the low wattage range, the high wattage range limits are much too wide. This happens because when fewer main winding turns are selected for the high wattage range, the effective flux leakage between main winding and control winding is reduced so that the control winding has more effect on the reactance.

SUMMARY OF THE INVENTION

The general objective of the invention is to provide a more efficient and effective variable reactance inductor suitable for regulating the wattage supplied to a discharge lamp in order to stabilize its light output, and also suitable for varying the wattage in order to provide different light levels.

A more specific object is to provide a controlled variable reactance inductor having two or more adjustable ranges for operating an HID lamp at several wattage levels and for regulating the current supplied to the lamp at the selected level while minimizing undesirable effects on lamp voltage and line current. In particular it is desired to equalize the control effects in terms of wattage over the several ranges.

A variable reactance inductor ballast embodying the invention comprises at least two running windings and a control winding on a magnetic core. For convenience, one running winding is termed the main winding and the other, the extended winding. A range switch allows the main winding to be used alone or with the extended winding connected in series to provide different wattage levels to the lamp. A shunt providing magnetic leakage separates the control winding from the running windings on the core. An electronic switch such as a triac is connected across the control winding for varying the inductance of the running windings. In accordance with the invention, a second magnetic leakage shunt is provided and separates the two running windings, that is it separates the extended winding from the main winding. The second shunt assures more flux leakage between the main winding and the control winding. As a result, when the main winding is used alone, the control winding has less effect on the reactance. This permits the high wattage range limits to be narrowed and made more nearly equal to the low wattage range limits.

DESCRIPTION OF DRAWING

The single FIGURE of the drawing is a schematic diagram of a variable reactance ballast device embodying the invention.

DETAILED DESCRIPTION

Referring to the drawing, there is shown a ballast and control apparatus constructed in accordance with the invention and comprising a shell type magnetic core formed by E laminations 1 and I laminations 2. The E laminations comprise central leg 1*a* around which the windings are located and outer legs 1*b* and 1*c*. In a preferred embodiment central leg 1*a* is slightly shorter than the outer legs so as to leave a narrow gap 3 of predetermined length between the end of the leg and yoke member 2 when the yoke member is in contact with the ends of the outer legs. Gap 3, referred to herein as the main gap, may be an air gap or a space filled by electrically insulating material such as Kraft paper. The running windings comprise main winding 4 and extended winding 5 which are spaced apart and serially connected. Terminal 6*a* of a source of alternating current may be connected by range switch 7 either to one end of main winding 4 through tap 8, or to the remote end of extended winding 5 through conductor 9. The switch has been illustrated in the position of connecting only main winding 4 in the lamp circuit for the high wattage range. In its opposite extreme position, the switch connects windings 4 and 5 in series in the lamp circuit for the low wattage range. At its other side, main winding 4 is connected in series with lamp 10 which is typically a high intensity discharge lamp. For the present example, it would be a high pressure sodium vapor lamp of 400 watts nominal rating which can accept up to 450 watts input.

A control winding 11 is provided on central leg 1*a* at the end opposite from main winding 4. The ends of the control winding are connected to the main electrodes of an electronic switch constituted by triac 12. As well understood in the art, a triac is an alternating current semiconductor controlled switch having a single control electrode 13. Gating the control electrode causes the switch to conduct current in the direction corresponding to the forward bias condition for the duration of the voltage wave applied across the main electrodes. It will be understood that other types of switches may be used if desired, such as reversely arranged SCR's or even gas-filled triodes (thyratrons). Connected to control electrode 13 is an actuating circuit 14 for triggering triac 12 to conductive condition in opposite directions at predetermined times corresponding to the firing phase angle. Actuating circuit 14 may be of any desired or well-known type for actuating the triac such as those shown in U.S. Pat. Nos. 3,500,124 and 3,629,683.

A first pair of magnetic shunts 15, 15′ are arranged extending across the spaces or windows on each side of central core leg 1*a* and located between the control winding 11 and extended running winding 5. Each shunt comprises an assembly of superposed magnetic laminations and is spaced on at least one side from one of the core legs by a non-magnetic gap, or if preferred on both sides as illustrated at 15″. Like gap 3, this may be an air gap or space occupied by electrically insulating spacer material. The shunts 15, 15′ provide the gapped magnetic shunt means separating the control winding from the running winding on the core which are called for by the Willis patent.

In accordance with my invention, a second pair of magnetic shunts 16, 16′ are arranged extending across the windows on each side of central core leg 1*a* and located between the main winding 4 and the extended winding 5. Magnetic shunts 16, 16′ are similar to shunts 15, 15′ and include air gaps or spaces 16″ occupied by electrically insulating spacer material. In other words they provide gapped magnetic shunt means separating the main winding from the extended winding. This second pair of shunt means allows the low wattage range to cover percentage wise more wattage control area than the high wattage range covers. By so doing, the numerical size of the wattage control area can be made more nearly equal in the two ranges.

The invention can be most readily understood by considering initially the prior art situation. First, assume only one shunt means between running and control winding as in the Willis patent, and consider the higher wattage range when main winding 4 alone is connected in the lamp operating circuit. The lower lamp wattage limit occurs when the control winding is open. As with any ordinary reactor, the reactance is determined by the number of turns on the winding and the magnetic path, the included air gap 3 providing most of the reluctance. The inductance in henrys of the reactor is given by:

$$L_1 = \frac{N_m^2}{l/A} \cdot \mu$$

where $N_m$=number of turns in the main winding l=length of air gap,

A=area of core cross section $\mu$=permeability of the gap.

As seen from the equation, the reactance can be increased by increasing the number of active turns and this will lower lamp wattage.

The upper lamp wattage limit of the higher wattage range occurs when the control winding is shorted. The current induced in the control winding produces a counter magnetomotive force that causes most of the flux created by the main winding to go through the magnetic shunt 15, 15′ and its air gap. This increases the reluctance of the magnetic path, reducing the reactance and increasing lamp wattage. The inductance $L_2$ then is given by:

$$L_2 = \frac{N_m^2}{\frac{l}{A} + \frac{l_s}{A_{s1}}} \cdot \mu$$

where l=length of shunt (15, 15′) air gap $A_{sl}$=area of shunt (15, 15′) cross section.

Consider now the lower wattage range when extended winding 5 is connected into the circuit in series with main winding 4. The lower lamp wattage limit occurs when the control winding is open. The inductance $L_3$ then is given by:

$$L_3 = \frac{(N_m + N_e)^2}{\frac{l}{A}} \cdot \mu$$

where $N_e$=number of turns in the extended winding.

The upper lamp wattage limit of the lower wattage range occurs when the control winding is shorted. The inductance $L_4$ then is given by:

$$L_4 = \frac{(N_m + N_e)^2}{\frac{l}{A} + \frac{l_s}{A_{s1}}} \cdot \mu$$

It will be observed that the ratio of $L_1$ to $L_2$ is identical to the ratio of $L_3$ to $L_4$. For the reasons previously pointed out, this is an undesirable situation. In accordance with my invention, it is overcome by providing a second shunt means 16, 16' located between the main winding 4 and the extended winding 5. The manner in which the second shunt means achieves such result may be understood as follows.

With two shunts, the inductance $L_5$ at the lower lamp wattage limit of the higher wattage range is given by:

$$L_5 = \frac{N_m^2}{l/A} \cdot \mu$$

The inductance $L_6$ at the upper limit of the high wattage range is given by:

$$L_6 = \frac{N_m^2}{\frac{l}{A} + \frac{l_s}{A_{s1} + A_{s2}}} \cdot \mu$$

where $A_{s2}$ = area of second shunt cross section (16, 16').

The inductance $L_7$ at the lower lamp wattage limit of the lower wattage range is given by:

$$L_7 = \frac{(N_m + N_e)^2}{\frac{l}{A}} \cdot \mu$$

It will be observed that $L_5$ and $L_7$ are identical with their prior art counterparts $L_1$ and $L_3$. Also $L_6$ is essentially the same as $L_2$ when the sum of the shunt cross-sections $A_{s1}+A_{s2}$ is considered as replacing the cross-section of the original single shunt. The change afforded by the invention is observed in the inductance $L_8$ at the upper lamp wattage limit of the lower wattage range. The inductance $L_8$ is determined by the first leakage shunt 15, 15' with the control winding shorted. Since this shunt is located between the extended winding 5 and the control winding 11, it determines the magnetic coupling. At this time, the same current is flowing in the extended winding as in the main winding, so that the second leakage shunt 16, 16' has almost no effect. In equation form, the inductance $L_8$ then is approximated by:

$$L_8 = \frac{(N_m + N_e)^2}{\frac{l}{A} + \frac{l_s}{A_{s1}}} \cdot \mu$$

Comparing $L_8$ which determines the upper limit of the lower wattage range in accordance with the invention with $L_4$ which determined it prior to the invention, the big change is that now only part of the total shunt area, namely $A_{s1}$ only, appears in the denominator. This enables the upper limit of the lower wattage range to be raised much higher than in the prior art inductor without affecting the limits of the higher wattage range.

When the area of shunt 15, 15' is reduced, the upper limit is increased and the area is adjusted to set the upper limit of the lower wattage range. The upper limit of the higher wattage range is determined by the sum of the areas of shunt 15, 15' and shunt 16, 16'. Thus as the area of shunt 15, 15' is adjusted for the low wattage range, an equal and opposite adjustment should be made to the area of shunt 16, 16'.

It may be desirable to have more than two wattage control ranges. To further improve line current and lamp voltage in the example given, the wattage range of 150 to 450 watts may be broken into three ranges, 150 to 250 watts, 300 to 350 watts, and 400 to 450 watts. This places the widest control range at the lowest wattage where line current and lamp voltage are a lesser problem. The middle range is achieved by providing intermediate tap 17 in the extended winding 5 and connecting it to an intermediate position of range switch 8, as shown in dot-dash lines in the drawing.

While the invention has been described with reference to a particular embodiment, it will be understood that numerous modifications may be made by those skilled in the art without departing from the spirt of the invention. To mention but the most obvious, the invention is equally applicable to core type magnetic core construction using U-I laminations. Also various circuit arrangements commonly used in lamp ballasting devices may be utilized, such as transformer or autotransformer connections for the purpose of adapting the devices for use with a wide range of line voltages as shown in the Willis patent. The appended claims are intended to cover all such equivalent variations.

What I claim as new and desire to secure by Letters Patent of the United States is:

1. An electrical ballast comprising:

a magnetic core forming a closed magnetic circuit, running windings comprising a main and an extended winding spaced on said core, a control winding on said core spaced from the running windings, means for connecting said main winding and a gaseous discharge lamp across an alternating current source to form a lamp operating circuit, range switch means for connecting said extended winding in series with said main winding in said lamp operating circuit, a pair of gapped magnetic shunt means in said core, one located between said control winding and said extended winding and the other between said extended winding and said main winding, electronic switch means connected across said control winding to control the current therein and thereby the reactance of said running windings, said shunt means assuring a proportionally greater control effect on the reactance in the lamp operating circuit when the extended winding is connected into the lamp operating circuit than when it is not.

2. A ballast as in claim 1 wherein an air gap is included in the core forming said closed magnetic circuit.

3. A ballast as in claim 1 wherein the main winding, the extended winding and the control winding are all spaced side by side on said magnetic core.

4. A ballast as in claim 1 wherein the magnetic core comprises an E-shaped member having a central leg and a pair of outer legs, and a yoke member closing the open end of the E-shaped member, and wherein all the windings are spaced side by side on said central leg.

5. A ballast as in claim 4 wherein the shunt pairs are placed between the central leg and the outer legs.

6. A ballast as in claim 1 adapted for three wattage ranges and including an intermediate tap in said extended winding and an additional position in said range switch means connecting to said tap.

* * * * *